US010978237B2

(12) United States Patent
Kobayashi et al.

(10) Patent No.: US 10,978,237 B2
(45) Date of Patent: Apr. 13, 2021

(54) CORE FOR STATIONARY INDUCTION APPARATUS

(71) Applicant: Hitachi, Ltd., Tokyo (JP)

(72) Inventors: Chie Kobayashi, Tokyo (JP); Akira Nishimizu, Tokyo (JP); Naoyuki Kurita, Tokyo (JP); Akira Yamagishi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 363 days.

(21) Appl. No.: 15/879,055

(22) Filed: Jan. 24, 2018

(65) Prior Publication Data

US 2018/0233267 A1 Aug. 16, 2018

(30) Foreign Application Priority Data

Feb. 13, 2017 (JP) ..... JP2017-023821

(51) Int. Cl.
*H01F 27/25* (2006.01)
*H01F 27/245* (2006.01)
(Continued)

(52) U.S. Cl.
CPC ..... *H01F 27/25* (2013.01); *H01F 3/10* (2013.01); *H01F 27/245* (2013.01); *H01F 27/28* (2013.01);
(Continued)

(58) Field of Classification Search
CPC ..... H01F 27/25; H01F 3/10; H01F 27/245; H01F 2003/106; H01F 27/263
See application file for complete search history.

(56) References Cited

U.S. PATENT DOCUMENTS 6,005,468 A * 12/1999 Shirahata ..... H01F 27/306 336/210
2002/0157239 A1* 10/2002 Ngo ..... H01F 27/266 29/606
(Continued)

FOREIGN PATENT DOCUMENTS

CN 101436459 A 5/2009
JP 57-90917 A 6/1982
(Continued)

OTHER PUBLICATIONS

Japanese-language Office Action issued in Japanese Application No. 2017-023821 dated May 19, 2020 with English translation (11 pages).
Japanese-language Office Action issued in Japanese Application No. 2017-023821 dated Feb. 18, 2020 with English translation (11 pages).
(Continued)

*Primary Examiner* — Tuyen T Nguyen
(74) *Attorney, Agent, or Firm* — Crowell & Moring LLP

(57) ABSTRACT

The invention provides a core for a stationary induction apparatus including an amorphous core formed of an amorphous thin magnetic strip arranged inside the core, a silicon steel sheet core formed of a silicon steel sheet arranged on a side surface of the amorphous core, a wear plate arranged on the outermost peripheral surface of the silicon steel sheet core, an amorphous core frame arranged around the amorphous core including a space between the amorphous core and the silicon steel sheet core, and a support frame which supports and fixes the amorphous core and the silicon steel sheet core via the wear plate.

9 Claims, 3 Drawing Sheets

(51) Int. Cl.

| | |
|---|---|
| ***H01F 3/10*** | (2006.01) |
| ***H01F 27/29*** | (2006.01) |
| ***H01F 27/28*** | (2006.01) |
| ***H01F 27/30*** | (2006.01) |
| *H01F 27/26* | (2006.01) |

(52) U.S. Cl.
CPC ..... *H01F 27/29* (2013.01); *H01F 27/30* (2013.01); *H01F 27/263* (2013.01); *H01F 2003/106* (2013.01)

(56) References Cited

U.S. PATENT DOCUMENTS

| | | | | |
|---|---|---|---|---|
| 2012/0056706 | A1 | 3/2012 | Schäfer et al. | |
| 2013/0307659 | A1* | 11/2013 | Johnson | H01F 27/263 336/210 |
| 2018/0040409 | A1 | 2/2018 | Oono et al. | |

FOREIGN PATENT DOCUMENTS

| | | | | | |
|---|---|---|---|---|---|
| JP | 57-143808 | A | | 9/1982 | |
| JP | 58-193620 | U | | 12/1983 | |
| JP | 61-198706 | A | | 9/1986 | |
| JP | 4-131915 | U | | 12/1992 | |
| JP | 8-88128 | A | | 4/1996 | |
| JP | 10-340815 | A | | 12/1998 | |
| JP | 2003-77735 | A | | 3/2003 | |
| JP | 2012-69943 | A | | 4/2012 | |
| JP | 2012069943 | A | * | 4/2012 | H01F 27/266 |
| JP | 2016-63140 | A | | 4/2016 | |
| JP | 201 6-174113 | U | | 9/2016 | |

OTHER PUBLICATIONS

Japanese-language Office Action issued in Japanese Application No. 2017-023821 dated Dec. 11, 2020 with English translation (19 pages).

* cited by examiner

CORE FOR STATIONARY INDUCTION APPARATUS

CLAIM OF PRIORITY

The present application claims priority from Japanese Patent application serial no. 2017-23821, filed on Feb. 13, 2017, the content of which is hereby incorporated by reference into this application.

BACKGROUND OF THE INVENTION

Field of the Invention

The present invention relates to a core for a stationary induction apparatus, in particular, to a core for a stationary induction apparatus suitable for those using an amorphous thin magnetic strip and a silicon steel sheet in the core of a stationary induction apparatus such as a transformer or a reactor.

Background Art

Energy consumption has been increasing with the world economic growth, reaching 3.3 times in about 50 years from 1965 to 2014.

Generally silicon steel sheets with little loss and high magnetic permeability have been used as core materials of transformers. However, a demand for a highly efficient transformer using an iron-based amorphous alloy instead of a silicon steel sheet (hereinafter referred to as an amorphous transformer) as a core material of the transformer has been increasing in recent years due to an increase in energy-saving needs accompanying an increase in energy consumption.

Comparing with a silicon steel sheet, the iron-based amorphous alloy has a higher electric resistivity and a smaller eddy current loss because it has a sheet thickness as thin as 1/10. Further, the iron-based amorphous alloy has characteristics of an easy domain wall displacement because it is amorphous and a small hysteresis loss, and thus it has an advantage that a non-load loss which always occurs even when there is no load of a transformer is low. Utilizing this advantage, amorphous transformers are attracting attention as a technology that has a high effect of introducing to an electricity distribution network with a low operation load rate.

An amorphous thin magnetic strip used for the core of the amorphous transformer is produced by rapidly cooling a melt of a magnetic alloy. In a case of producing a transformer core using an amorphous thin magnetic strip, the cut amorphous thin magnetic strips are laminated such that a lamination cross section forms a U shape, and after a winding is inserted, a core forming a closed magnetic circuit is made by alternately superposing the left and right amorphous thin magnetic strips using a method called a butt joint or a lap joint. Before the operation of inserting the winding into the core, a process of annealing in a magnetic field is conducted in a state where a wound core is molded in order to eliminate an influence of a stress caused by the laminating operation of the amorphous thin magnetic strips.

Moreover, besides the above-mentioned advantage, the amorphous thin magnetic strips forming the core have a property of being hard and brittle, and since they are formed by laminating hundreds of sheets of a thin strip with a thickness of tens of it is not possible to obtain sufficient mechanical strength and rigidity and self-standing like a silicon steel sheet is difficult. In the case of a small-capacity transformer (for example, a pole transformer), the ratio of the size of a limb part and the size of a yoke part of the core is small and it is possible to hold the shape of the core by rigidity and the like of the winding. However, in the case of a large-capacity transformer (for example, a power transformer), since the limb part of the core becomes larger than the yoke part and the deadweight also becomes larger, it is necessary to provide a strong and a large-scale holding member to hold the core.

In a core using a silicon steel sheet commonly used in a large-capacity transformer, the silicon steel sheet is hundreds of μm thick and self-standing is easy. Moreover, processing such as directly supporting the core using a wear plate is also easy. In contrast, the amorphous thin magnetic strip is difficult to process and the magnetic loss deteriorates sensitively to a stress, and thus it is necessary to devise a supporting method.

For example, it is disclosed in JP-A-8-88128 that as materials constituting a multiphase transformer core, a wound amorphous thin magnetic strip effective in reducing magnetic loss is used as an inner core and a wound or laminated silicon steel sheet is used as an outer core, and as a composite structure of both cores, an attempt is made to enhance the characteristic of magnetic loss and the mechanical strength and rigidity of the cores at the same time to ensure workability in assembly work.

SUMMARY OF THE INVENTION

As a technology to overcome an insufficiency of mechanical strength and rigidity of a core for a stationary induction apparatus, an attempt is made in JP-A-8-88128 to enhance the characteristic of magnetic loss and the mechanical strength and rigidity of the cores at the same time by using a wound amorphous thin magnetic strip effective in reducing magnetic loss as an inner core and using a wound or laminated silicon steel sheet as an outer core to form a composite structure of both cores.

Since a saturation magnetic flux density of the amorphous thin magnetic strip at 50 Hz is about 1.6 T and a saturation magnetic flux density of the silicon steel sheet is about 2.0 T, in order to average the magnetic flux density distribution in the cores, it is more advantageous to arrange the amorphous thin magnetic strip in the inner core with a shorter magnetic circuit length, and such a configuration is common.

However, when the core is increased in size, arranging the amorphous thin magnetic strip in the inner core makes the amorphous core at the inner side to easily collapse toward the inside of a window of a space portion, making self-standing difficult, and thus a strong holding member becomes necessary. In addition, when a strong holding member is used, the holding member may increase a stray loss. Moreover, a compressive stress of the silicon steel sheet is applied to the amorphous thin magnetic strip, and thus the magnetic loss may increase due to load.

The invention has been made in view of the above circumstances, and an object of the invention is to provide a core for a stationary induction apparatus which is possible to protect the core while clamping the core evenly, as well as having a high mechanical strength and a low magnetic loss even when the core using an amorphous thin magnetic strip and a silicon steel sheet is increased in size.

In order to achieve the above object, the core for a stationary induction apparatus of the invention includes an amorphous core formed of an amorphous thin magnetic strip arranged inside the core, a silicon steel sheet core formed of a silicon steel sheet arranged on a side surface of the amorphous core, a wear plate arranged on the outermost peripheral surface of the silicon steel sheet core, an amorphous core frame arranged around the amorphous core including a space between the amorphous core and the silicon steel sheet core, and a support frame which supports and fixes the amorphous core and the silicon steel sheet core via the wear plate.

According to the invention, it is possible to obtain a core for a stationary induction apparatus which is possible to protect the core while clamping the core evenly, as well as having a high mechanical strength and a low magnetic loss even when the core using an amorphous thin magnetic strip and a silicon steel sheet is increased in size.

DETAILED DESCRIPTION OF THE INVENTION

Hereinafter, the core for a stationary induction apparatus of the invention will be described based on the illustrated examples. In each example, the same reference signs are used for the same components.

Example 1

Figure 1:
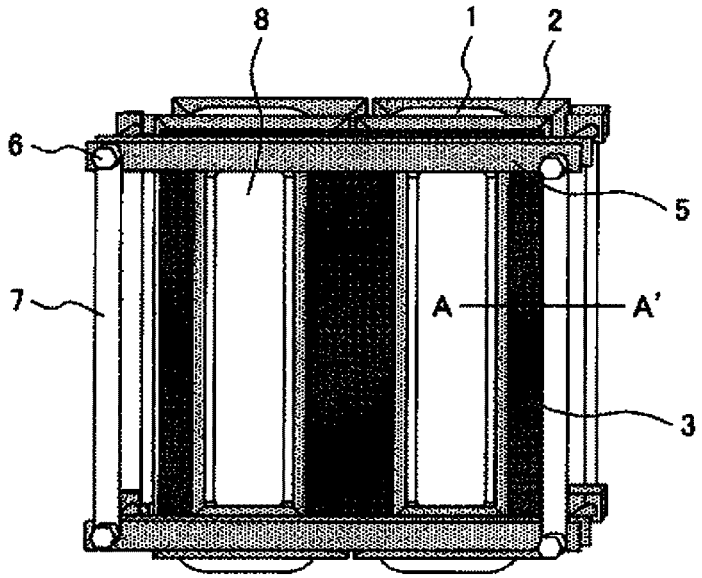
FIG. 1 is a perspective view of Example 1 of a core for a stationary induction apparatus of the invention.
Figure 2:
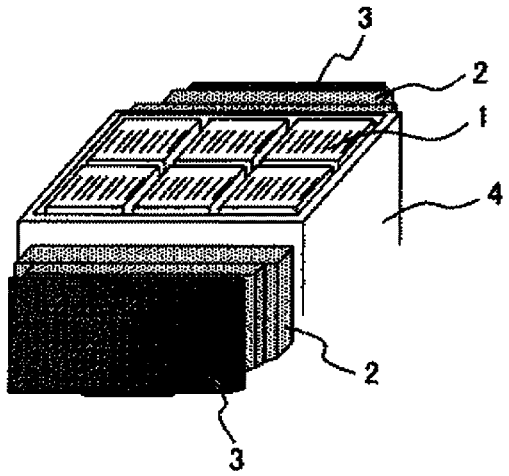
FIG. 2 is a perspective view of the core for a stationary induction apparatus of Example 1 of FIG. 1 taken along a line A-A'.

FIG. 1 and FIG. 2 show Example 1 of a core fora stationary induction apparatus of the invention.

As shown in the figures, the core for a stationary induction apparatus of the present example schematically includes an amorphous core 1 formed of an amorphous thin magnetic strip arranged inside the core, a silicon steel sheet core 2 formed of a silicon steel sheet arranged on both sides (both side surfaces) of the amorphous core 1, a wear plate 3 arranged on the outermost peripheral surface of the silicon steel sheet core 2, an amorphous core frame 4 arranged around the amorphous core 1 including a space between the amorphous core 1 and the silicon steel sheet core 2, and a support frame 5 which supports and fixes the amorphous core 1 and the silicon steel sheet core 2 via the wear plate 3 by clamping them with a clamping jig (for example, a bolt) 6.

The support frame 5 is arranged in a transverse direction on an upper portion and a lower portion of an outer peripheral surface of the wear plate 3, and the support frame 5 arranged in the transverse direction on an upper portion and a lower portion supports and fixes the amorphous core 1 and the silicon steel sheet core 2 via the wear plate 3 by clamping them with the clamping jig 6. In addition, the support frame 5 arranged in the transverse direction on an upper portion and a lower portion of the outer peripheral surface of the wear plate 3 is connected by a second support frame 7 arranged between the upper and the lower sides of the support frame 5.

The amorphous core 1, which is a constituent element of FIG. 1 and FIG. 2, is an amorphous wound core in which an amorphous thin magnetic strip is wound in a roughly rectangular shape. However, it can also be an amorphous laminated core formed by laminating an elongated amorphous thin magnetic strip and then butting both ends to form a roughly rectangular shape. The silicon steel sheet core 2 is a silicon steel-stacked block core formed by laminating a plurality of silicon steel sheets and forming a step-lap joint structure at a corner. However, it can also be a silicon steel sheet wound core formed by winding a silicon steel sheet into a roughly rectangular shape.

Since the amorphous core frame 4 is configured to surround a magnetic limb of the amorphous core 1, it is desirable that it is made of a nonmagnetic material such as SUS, Al, wood and a resin, or it is desirable to have a configuration in which a nonmagnetic material such as a resin is interposed in a part of a magnetic material such that the magnetic limb is not surrounded by the magnetic material in a circle. When a material such as iron is used for the amorphous core frame 4, it is desirable that an insulator such as a press board is interposed between the amorphous core 1 and the amorphous core frame 4 such that the amorphous core 1 and the amorphous core frame 4 do not come into direct contact.

The wear plate 3 is a quadrangle where a portion equivalent to a window 8 of the core is cut out corresponding to the shape of the silicon steel sheet core 2, and it can be integrally formed or divided into a plurality of parts. As the material, the wear plate 3 may be made of iron, and it may also be made of a nonmagnetic material such as SUS, Al, wood and a resin. When the wear plate 3 is made of iron, an eddy current loss due to interlinkage flux is reduced by inserting a slit in the wear plate 3, and thus heat generation of the wear plate 3 can be prevented.

Since the support frame 5 is configured to surround the core, it is desirable that it is made of a nonmagnetic material such as SUS, Al, wood and a resin, or it is desirable to have a configuration in which a nonmagnetic material such as a resin is interposed in a part of a magnetic material such that the magnetic limb is not surrounded by the magnetic material in a circle.

Generally the amorphous thin magnetic strip is as thin as tens of μm in thickness of one sheet. Since hundreds of sheets are laminated, self-standing is difficult. In contrast, since the silicon steel sheet is about 10 times as thick as the amorphous thin magnetic strip, self-standing is possible. Therefore, it is possible to suppress shape deformation of the amorphous core 1 by arranging the silicon steel sheet core 2 on the outer periphery of the amorphous core 1 and further clamping and fixing the amorphous core 1 and the silicon steel sheet core 2 using the wear plate 3. By clamping and fixing using the wear plate 3, it is not only possible to clamp the amorphous core 1 and the silicon steel sheet core 2 evenly but also possible to protect the amorphous core 1 and the silicon steel sheet core 2 because no clamping force is directly applied to the amorphous core 1 and the silicon steel sheet core 2.

Moreover, the amorphous core 1 is sensitive to stress, and thus iron loss increases when a clamping pressure is directly applied. In particular, it is necessary to support the core with a support frame in a large core; however, in the configuration of the example, it is not necessary to directly press the amorphous core 1, and thus deterioration of iron loss can be prevented.

The rigidity of the core can be further strengthened by using a piece of an integral wear plate 3 which is not divided.

Figure 3:
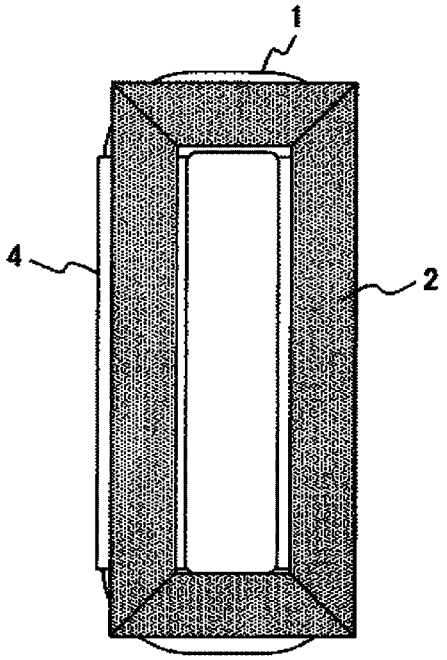
FIG. 3 is a diagram of a minimum unit of the core constituting Example 1 of the core for a stationary induction apparatus of FIG. 1.

FIG. 3 shows a minimum unit (the left half of FIG. 1) of a core for a stationary induction apparatus including the amorphous core 1 and the silicon steel sheet core 2 shown in FIG. 1 and FIG. 2.

As shown in FIG. 3, by separately producing the core for a stationary induction apparatus in minimum units and assembling, it is possible to constitute a transformer using the same core no matter it is single-phase or three-phase, and thus productivity can be improved.

According to the configuration of the example as described above, a core for a stationary induction apparatus having a high mechanical strength and a low magnetic loss can be obtained even when the core using an amorphous thin magnetic strip and a silicon steel sheet is increased in size.

Example 2

Figure 4:
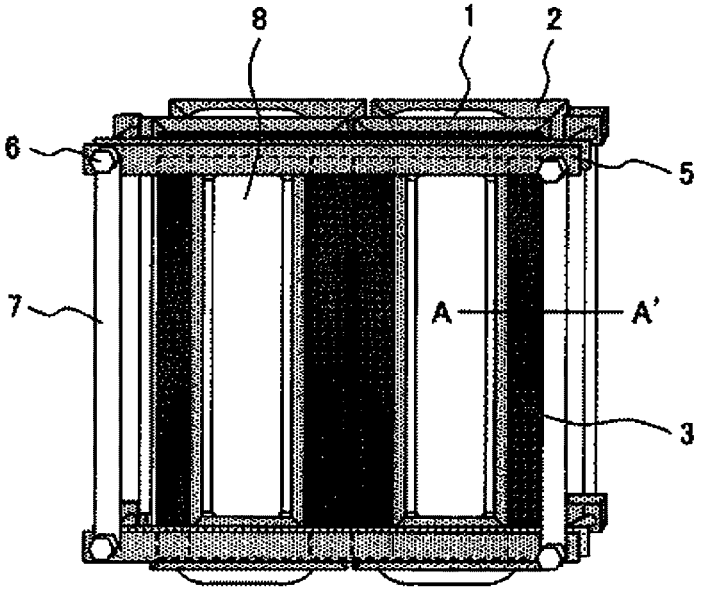
FIG. 4 is a perspective view of Example 2 of a core for a stationary induction apparatus of the invention.

FIG. 4 shows Example 2 of a core for a stationary induction apparatus of the invention.

The core for a stationary induction apparatus of the example shown in the figure is one in which the shape of the wear plate 3 arranged between the silicon steel sheet core 2 and the support frame 5 is modified in the configuration described in Example 1.

That is, as shown in FIG. 4, the wear plate 3 is divided into a plurality of pieces (8 in this example) in the example, and by using the divided wear plate 3, operation at the time of assembly becomes easy because the size of the wear plate 3 per piece can be reduced.

The wear plate 3 may be made of iron, and it may also be made of a nonmagnetic material such as SUS, Al, wood and a resin. When the wear plate 3 is made of iron, an eddy current loss due to interlinkage flux is reduced by inserting a slit in the wear plate 3, and thus heat generation of the wear plate 3 can be prevented.

Since the support frame 5 is configured to surround the core, it is desirable that it is made of a nonmagnetic material such as SUS, Al, wood and a resin, or it is desirable to have a configuration in which a nonmagnetic material such as a resin is interposed in a part of a magnetic material such that a magnetic limb is not surrounded by the magnetic material in a circle.

It is possible to obtain the same effect as in Example 1 even with such a configuration of the example.

Example 3

Figure 5:
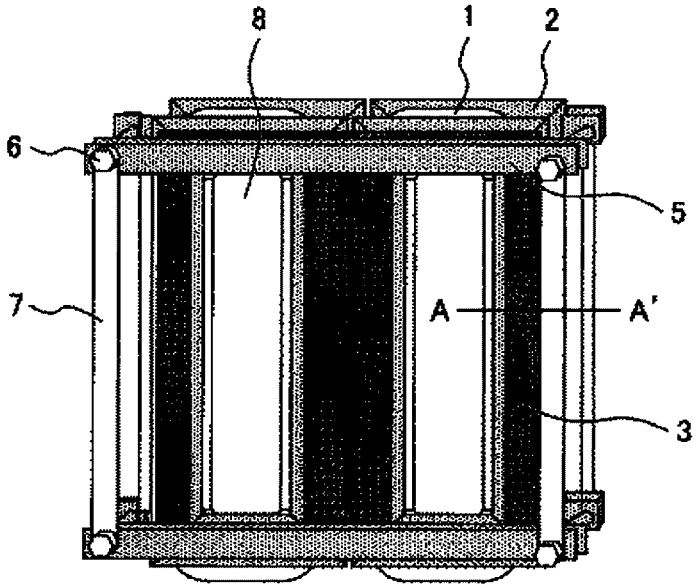
FIG. 5 is a perspective view of Example 3 of a core for a stationary induction apparatus of the invention.
Figure 6:
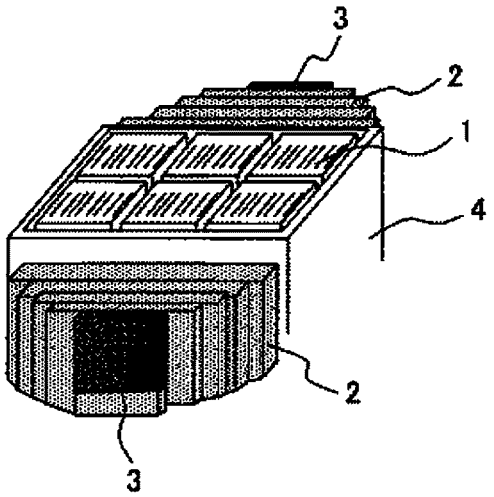
FIG. 6 is a perspective view of the core for a stationary induction apparatus of Example 3 of FIG. 5 taken along a line A-A'.

FIG. 5 and FIG. 6 show Example 3 of a core for a stationary induction apparatus of the invention.

The core for a stationary induction apparatus of the example shown in the figures is one in which silicon steel sheets are stacked and the width of the silicon steel-stacked block core 2 where a step-lap joint structure is formed at a corner is modified in the configuration described in Example 1.

That is, the silicon steel-stacked block core 2 is configured such that the width decreases sequentially from the amorphous core 1 side toward the wear plate 3 side.

By the configuration of the example, it is not only possible to obtain the same effect as in Example 1, but also possible to make the cross section of the core into an approximately circular shape, to arrange the core in a circular winding without waste and to increase winding space factor of the core.

In addition, it may also be configured that only the yoke part of the silicon steel sheet core 2 is a plate of the same width and the core yoke part is clamped by the support frame 5, so that the core can be clamped without decreasing the clamping area.

The above examples have been described in detail in order to explain the invention in an easy-to-understand manner, and are not necessarily limited to those having all the configurations described. In addition, it is possible to replace a portion of the configuration of certain example with the configuration of another example and the configuration of another example can be added to the configuration of certain example. In addition, it is possible to add, delete, and replace other configurations with respect to a portion of the configuration of each example.

What is claimed is:

1. A core for a stationary induction apparatus comprising:

an amorphous core with a rectangular cross section formed of an amorphous thin magnetic strip arranged inside the core, a silicon steel sheet core formed of a silicon steel sheet arranged so as to face only a pair of opposite side surfaces of the amorphous core with the rectangular cross section, a wear plate arranged on the outermost peripheral surface of the silicon steel sheet core, an amorphous core frame arranged around the amorphous core including a space between the amorphous core and the silicon steel sheet core, and a support frame which supports and fixes the amorphous core and the silicon steel sheet core via the wear plate, wherein the amorphous core is an amorphous wound core in which an amorphous thin magnetic strip is wound in a roughly rectangular shape, a minimum unit of the amorphous wound core being formed by dividing the amorphous magnetic strip into a plurality of bundles and arranging them vertically and horizontally when the amorphous core is horizontally cross-sectioned and viewed from a plan view, the silicon steel sheet core is a silicon steel-stacked block core formed by stacking the silicon steel sheets and forming a step-lap joint structure at a corner, and the amorphous core frame is made of iron and has openings at the top and bottom through which the amorphous core passes, and an insulator is interposed between the amorphous core frame made of iron and the amorphous core.

2. The core for a stationary induction apparatus according to claim 1, wherein the silicon steel-stacked block core is configured such that a width decreases sequentially from the amorphous core side toward the wear plate side.

3. The core for a stationary induction apparatus according to claim 1, wherein the support frame is arranged in a transverse direction on an upper portion and a lower portion of an outer peripheral surface of the wear plate, and the support frame arranged in the transverse direction supports and fixes the amorphous core and the silicon steel sheet core via the wear plate.

4. The core for a stationary induction apparatus according to claim 3, wherein the support frame arranged in a transverse direction on an upper portion and a lower portion of the outer peripheral surface of the wear plate is connected by a second support frame arranged between the upper and the lower sides of the support frame.

5. The core for a stationary induction apparatus according to claim 1, wherein the support frame is made of a nonmagnetic material or a magnetic material, and when the support frame is made of a magnetic material, a nonmagnetic material is interposed in a part of the magnetic material.

6. The core of a stationary induction apparatus according to claim 1, wherein the wear plate is a quadrangle where a portion equivalent to a window of the core is cut out corresponding to the shape of the silicon steel sheet core.

7. The core for a stationary induction apparatus according to claim 1, wherein the wear plate is integrally formed or divided into a plurality of parts.

8. The core for a stationary induction apparatus according to claim 1, wherein the wear plate is made of iron or a nonmagnetic material, and when the wear plate is made of iron, a slit is provided in the wear plate.

9. The core for a stationary induction apparatus according to claim 1, wherein the amorphous core frame is made of a nonmagnetic material or a magnetic material, and when the amorphous core frame is made of a magnetic material, a nonmagnetic material is interposed in a part of the magnetic material.

* * * * *